US007823966B2

(12) United States Patent
Buchholz

(10) Patent No.: US 7,823,966 B2
(45) Date of Patent: Nov. 2, 2010

(54) RECLINER CHAIR

(75) Inventor: Christian Buchholz, Gütersloh (DE)

(73) Assignee: Ferdinand Lusch GmbH & Co. KG, Bielefeld (DE)

( * ) Notice: Subject to any disclaimer, the term of this patent is extended or adjusted under 35 U.S.C. 154(b) by 0 days.

(21) Appl. No.: 11/769,285

(22) Filed: Jun. 27, 2007

(65) Prior Publication Data

US 2008/0012397 A1 Jan. 17, 2008

(30) Foreign Application Priority Data

Jun. 28, 2006 (DE) ..... 20 2006 010 070 U

(51) Int. Cl.
*A47C 1/02* (2006.01)

(52) U.S. Cl. ..... 297/89; 297/68; 297/85; 297/423.28; 297/423.3

(58) Field of Classification Search ..... 297/68, 297/85, 86, 89, 423.19, 423.28, 423.3
See application file for complete search history.

(56) References Cited

U.S. PATENT DOCUMENTS 3,058,774 A * 10/1962 Belisle et al. ..... 297/89
3,084,974 A * 4/1963 Belisle et al. ..... 297/89
3,087,754 A * 4/1963 Fletcher ..... 297/89
3,135,548 A * 6/1964 Fletcher et al. ..... 297/89
3,142,510 A * 7/1964 Fletcher ..... 297/89
3,317,240 A * 5/1967 Fletcher ..... 297/89
4,740,031 A 4/1988 Rogers, Jr.
6,540,291 B2 * 4/2003 Hoffman et al. ..... 297/85
6,572,185 B1 * 6/2003 Tseng ..... 297/85
7,357,450 B2 * 4/2008 Rogers ..... 297/68
2002/0149238 A1 * 10/2002 Hoffman et al. ..... 297/85

FOREIGN PATENT DOCUMENTS

CH 4 85 449 A 3/1970
DE 31 07 771 A1 9/1982
DE 201 04 538 U1 6/2001
DE 10 2005 002 431 6/2006

* cited by examiner

*Primary Examiner*—Laurie K Cranmer
(74) *Attorney, Agent, or Firm*—Henry M. Feiereisen; Ursula B. Day

(57) ABSTRACT

A chair includes a base structure and a seat which is movably secured to the base structure. Connected to the seat is a backrest for swinging in a virtually wall-avoiding manner. A footrest is movable between a stowed position when not being used and an extended position when in use, wherein the footrest is disposed in the stowed position below the seat in approximate parallel relationship thereto and has a seat-distal surface provided with a padding. The footrest is connected to the seat by a swivel fitting which is constructed such that a movement of the backrest causes a movement of the footrest.

9 Claims, 3 Drawing Sheets

RECLINER CHAIR

CROSS-REFERENCES TO RELATED APPLICATIONS

This application claims the priority of German Patent Application, Serial No. 20 2006 010 070.9, filed Jun. 28, 2006, pursuant to 35 U.S.C. 119(a)-(d), the content of which is incorporated herein by reference in its entirety as if fully set forth herein.

BACKGROUND OF THE INVENTION

The present invention relates, in general, to a chair, and more particularly to a recliner chair.

Nothing in the following discussion of the state of the art is to be construed as an admission of prior art.

U.S. Pat. No. 4,740,031 discloses a reclining chair having a backrest which can be placed virtually against a nearby wall in a room without offering any obstruction when the chair is placed into reclining position. In other words, the backrest can be moved forwards jointly with the seat in relation to a base structure by the weight of a chair occupant. A footrest linkage mounts a footrest relative to the seat for allowing the footrest to move between a retracted position and an extended position in which the footrest projects forwardly from the seat. The footrest can hereby swing between the retracted and extended positions at an angle range of about 90°. In the retracted position, the footrest extends upright and forms a visible front wall of the chair. Such an end position of the footrest is undesired for many reasons. For one, the footrest obstructs an unrestricted comfortable use of the chair because the area underneath the seat becomes inaccessible. As a result of this inaccessibility, not only does cleaning become complicated because it requires a shift of the footrest to the extended position in order to be able to reach the area underneath the seat, but also limits design concepts.

It would therefore be desirable and advantageous to provide an improved chair to obviate prior art shortcomings.

SUMMARY OF THE INVENTION

According to one aspect of the present invention, a chair includes a base structure, a seat movably secured to the base structure, a backrest connected to the seat for swinging in a virtually wall-avoiding manner, a footrest movable between a stowed position when not being used and an extended position when in use, wherein the footrest is disposed in the stowed position below the seat in approximate parallel relationship thereto and has a seat-distal surface provided with a padding, and a swivel fitting for connecting the footrest to the seat, with the swivel fitting being constructed such that a movement of the backrest causes a movement of the footrest.

The present invention resolves prior art problems by allowing the backrest to move relative to the seat so that the angle between the backrest and the seat increases, while the footrest is caused to move from the stowed position to the extended position. As a result, the pivoting angle of the footrest is maximized. Basically, the footrest can be moved from the stowed position to the extended position at an angle range of about 180°, so that the footrest forms ultimately an extension of the seat, when assuming the extended position. In the retracted stowed position, the footrest is positioned underneath the seat in substantial parallel relationship thereto, with the padding of the footrest disposed on the seat-distal side. As a consequence, and in view of the fact that the footrest is relatively thin, the leg room underneath the seat is clear to allow cleaning works for example, and the footrest is essentially invisible so that the chair receives an appealing look.

According to another feature of the present invention, two pivot levers may be provided to support the footrest, wherein the swivel fitting may include two couplers extending in substantial parallel relationship, with one of the couplers pivotally mounted to the pivot levers, and with the other one of the couplers pivotally mounted to one of the pivot levers.

According to another feature of the present invention, a linkage is provided between the swivel fitting and the backrest, with the linkage including a cantilever plate which is secured to the base structure, wherein the swivel fitting includes a guide link having one area articulated to the seat and another area articulated to the cantilever plate.

According to another feature of the present invention, the linkage may include a bracket mounted to the seat, a guide lever having one area swingably secured to the base structure and another area pivotally mounted to the bracket, and two control levers having adjacent ends supported by the guide lever. One of the control levers may hereby be connected to the backrest, and the other one of the control levers may be swingably connected to the swivel fitting. In this way, the footrest can be moved from the stowed position underneath the seat to the extended position, when the backrest is moved by the occupant through a shift of weight or by a motor mechanism.

A chair according to the present invention is equipped with a swivel fitting for the footrest, which swivel fitting is simple in construction and reliable in operation and allows the footrest to cover a wide movement range in relation to the seat.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
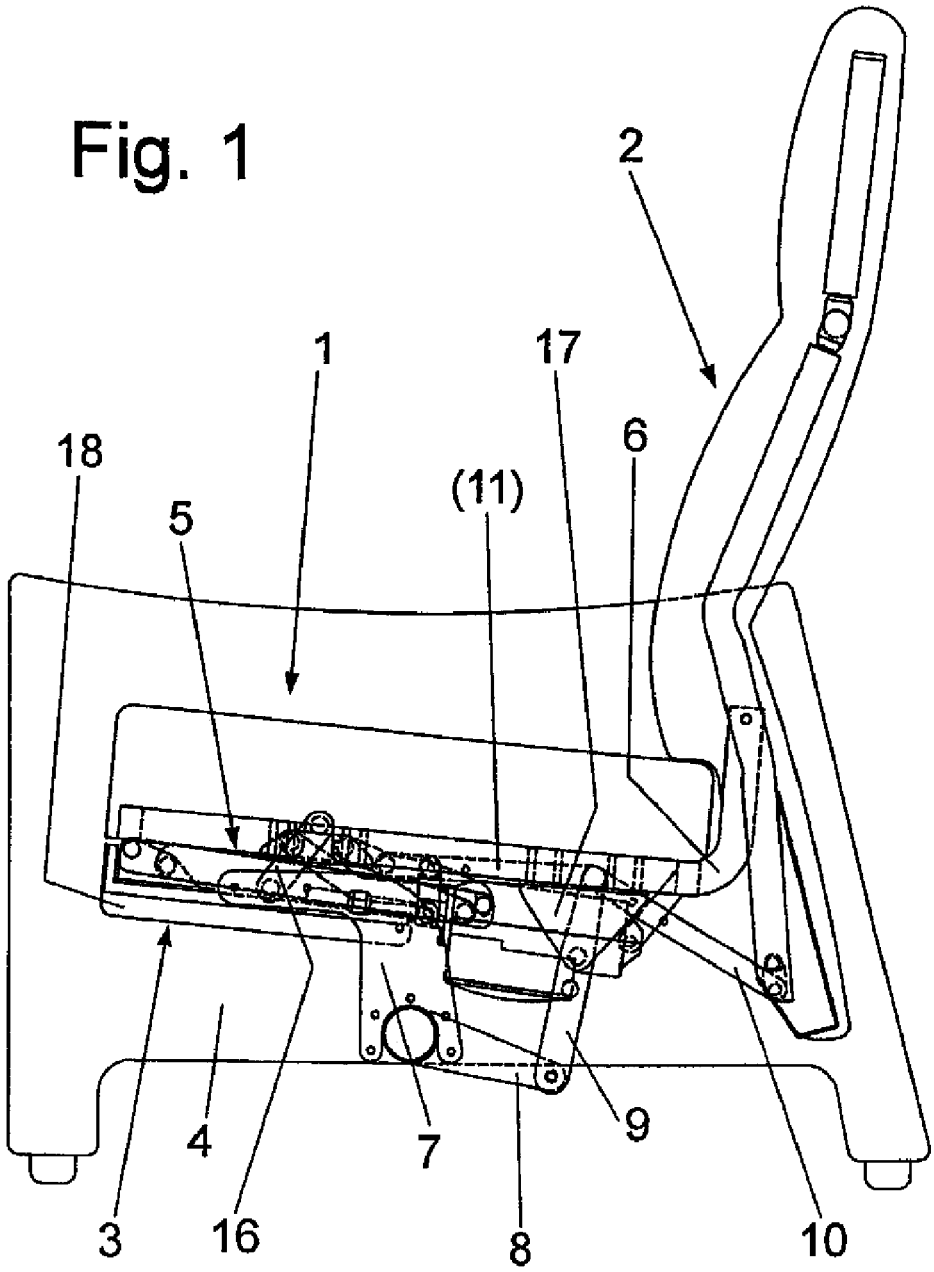
FIG. 1 is a schematic side view of a recliner chair according to the present invention, showing the chair in normal position with the footrest assuming a retracted stowed position.

Throughout all the Figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 2:
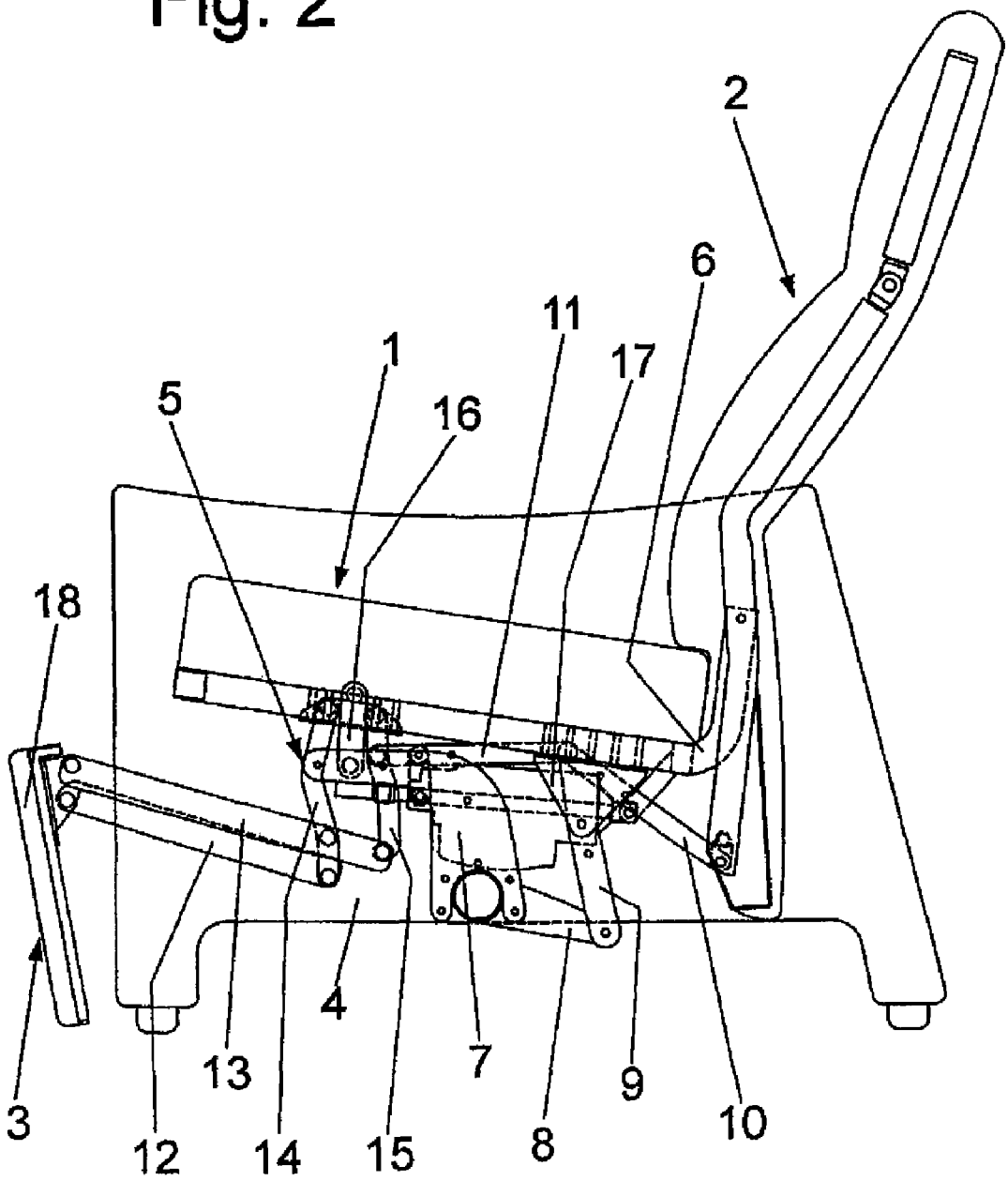
FIG. 2 is a schematic side view of the recliner chair in an intermediate position.
Figure 3:
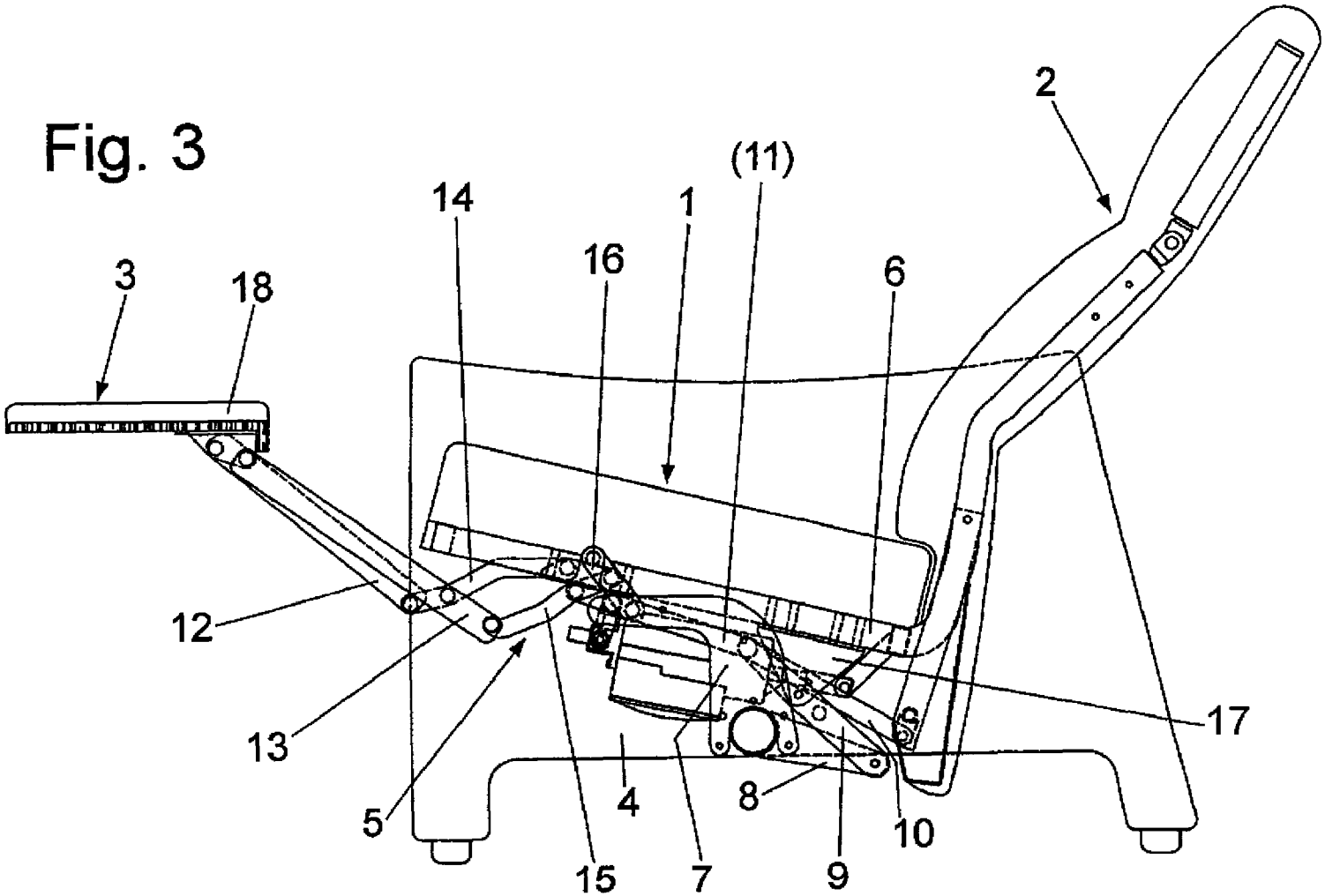
FIG. 3 is a schematic side view of the recliner chair in a reclined position, with the footrest assuming a fully extended position.

Turning now to the drawing, and in particular to FIG. 1, there is shown a schematic side view of a recliner chair according to the present invention, having a base structure 4 which includes two side panels, a seat 1 which is movably secured to the base structure 4, a backrest 2 which is connected to the seat 1 and can be placed virtually against a wall without interference from the wall when the backrest 2 is moved into a reclining position, and a footrest 3 which is movable between a retracted stowed position, when not being used, as shown in FIG. 1, and a fully extended position when in use, as shown in FIG. 3. FIG. 2 depicts an in-between position of the chair between the normal position and the reclining position.

The footrest 3 has a front side covered by a padding 18 for support of an occupant's legs, and a backside to which the ends of two pivot levers 12, 13 are swingably secured for support of the footrest 3.

The seat 1 is connected to the backrest 2 by a connection frame 6 which allows a slight increase in the angular relationship between the seat 1 and the backrest 2, when the backrest 2 is moved backwards to swing the chair into reclining position.

A swivel fitting 5 on each side of the side panel of the base structure 4 connects the footrest 3 to the seat 1. For convenience and sake of simplicity, the following description relates only to one side of the chair, when in fact the two sides of the chair are mirror images of one another about an imaginary vertical medial plane which bisects the left from the right of the chair. Thus, although the swivel fitting will be described with respect to only one side of the chair, it will be understood that the same components of a swivel fitting are duplicated on the opposite side of the chair.

The swivel fitting 5 includes two couplers 14, 15, which are disposed in substantial parallel relationship and rotatably supported on the seat 1, and a guide link 16, which is articulated to the seat 1. The coupler 15 is disposed proximate to a cantilever plate 7 which forms part of a linkage to connect the swivel fitting 5 to the seat 1 and the backrest 2. The cantilever plate 7 is mounted to the side panel of the base structure 4 for attachment of the guide link 16. The coupler 14 is disposed distal to the cantilever plate 7 and articulated to the pivot lever 12 as well as to the pivot lever 13 of the footrest 3, whereas the coupler 15 is connected to the pivot lever 13 only.

The swivel fitting 5 is connected via the linkage to the backrest 2 and constructed in such a way that a movement of the backrest 2 causes a movement of the footrest 3. Thus, the backrest 2 and the footrest 3 move in dependence on one another. To realize the movement dependency, a guide lever 9 is provided which is rotatably mounted in midsection to a bracket 17 that is firmly secured to the seat 1. The guide lever 9 has one end swingably secured to a support arm 8 which is firmly connected to the base structure 4. Rotatably secured to the other end of the guide lever 9 are two control levers 10, 11 which are pivotally connected to one another at their adjacent ends. The other end of the control lever 10 is articulated to the backrest 2, and the other end of the control lever 11 is articulated to the coupler 15 of the swivel fitting 5.

When the backrest 2 is moved backwards from the normal position, as shown in FIG. 1, in which the footrest 3 is retracted and stowed away underneath the seat 1 and the padding 18 extends parallel to the seating area of the seat 1 on the distal side of the footrest 3, the footrest 3 begins to move to the intermediate position, as shown in FIG. 2, while the seat 1 is moved forwards in relation to the base structure 4 by the guide link 16 and the guide lever 9. Upon continuing backward movement of the backrest 2, the seat 1 continues to move forward until the footrest 3 assumes the fully extended position, as shown in FIG. 3. In this position, the padding 18 is positioned atop.

As the front of the seat 1 is elevated, the bottom clearance is substantial so that the footrest 3 and the padding 18 can be sized large enough to provide an optimum foot support, while still allowing the footrest 3 to be retracted underneath the seat 1.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A chair, comprising:

a base structure;

a seat movably secured to the base structure;

a backrest connected to the seat for swinging in a virtually wall-avoiding manner;

a footrest movable between a stowed position when not being used and an extended position when in use, wherein the footrest is disposed in the stowed position below the seat in approximate parallel relationship thereto and has a seat-distal surface provided with a padding;

a swivel fitting for connecting the footrest to the seat, said swivel fitting being constructed such that a movement of the backrest causes a movement of the footrest; and a linkage between the swivel fitting and the backrest, wherein the linkage includes a bracket mounted to the seat, a guide lever having one end secured to the base structure for swinging about a fixed axis and another end pivotally mounted to the bracket, and two control levers having adjacent ends pivotally connected to the other end of the guide lever.

2. The chair of claim 1, further comprising two pivot levers for support of the footrest, wherein the swivel fitting includes two couplers extending in substantial parallel relationship, with one of the couplers pivotally mounted to both pivot levers, and with the other one of the couplers pivotally mounted to one of the pivot levers.

3. The chair of claim 1, wherein the linkage includes a cantilever plate which is secured to the base structure, wherein the swivel fitting includes a guide link having one area articulated to the seat and another area articulated to the cantilever plate.

4. The chair of claim 1, wherein one of the control levers has another end connected to the backrest.

5. The chair of claim 4, wherein the other one of the control levers has another end swingably connected to the swivel fitting.

6. The chair of claim 5, further comprising two pivot levers for support of the footrest, wherein the swivel fitting includes two couplers extending in substantial parallel relationship, with one of the couplers pivotally mounted to the pivot levers, and with the other one of the couplers pivotally mounted to one of the pivot levers, wherein the other one of the control levers is swingably secured to the other one of the couplers.

7. The chair of claim 1, wherein the seat has a connection frame which is pivotally mounted to the backrest.

8. The chair of claim 1, wherein the seat is elevated at its front to assume a slanted disposition, when the footrest moves from the stowed position to the extended position.

9. A chair comprising:

a base structure;

a seat movably secured to the base structure;

a backrest connected to the seat for swinging in a virtually wall-avoiding manner;

a footrest movable between a stowed position when not being used and an extended position when in use, wherein the footrest is disposed in the stowed position below the seat in approximate parallel relationship thereto and has a seat-distal surface provided with a padding;

a swivel fitting for connecting the footrest to the seat, said swivel fitting being constructed such that a movement of the backrest causes a movement of the footrest; and a linkage between the swivel fitting and the backrest, wherein the linkage includes a bracket mounted to the seat, a guide lever having one area swingably secured to the base structure and another area pivotally mounted to the bracket, and two control levers having adjacent ends pivotally connected to one end of the guide lever, wherein the seat is moved forwards, when the footrest moves from the stowed position to the extended position.

* * * * *